US006604962B1

(12) United States Patent
Eichmann et al.

(10) Patent No.: US 6,604,962 B1
(45) Date of Patent: Aug. 12, 2003

(54) PLUG FOR CONNECTION TO AN RCA OR PHONO TYPE SOCKET

(76) Inventors: Keith Louis Eichmann, 37 Varndell St, Bald Hills, Brisbane QLD 4037 (AU); Robert Bruce Woodland, 55 Lyndale Road, Pullenvale, Brisbane QLD 4069 (AU)

( * ) Notice: Subject to any disclaimer, the term of this patent is extended or adjusted under 35 U.S.C. 154(b) by 0 days.

(21) Appl. No.: 09/744,204

(22) PCT Filed: Feb. 4, 2000

(86) PCT No.: PCT/AU00/00064

§ 371 (c)(1),
(2), (4) Date: Jan. 18, 2001

(87) PCT Pub. No.: WO00/70717

PCT Pub. Date: Nov. 23, 2000

(30) Foreign Application Priority Data

May 18, 1999 (AU) ..... PQ 0429
Jan. 27, 2000 (AU) ..... PQ 5251

(51) Int. Cl.[7] ..... H01R 9/05

(52) U.S. Cl. ..... 439/578; 439/96; 439/462; 439/608

(58) Field of Search ..... 439/462, 95, 96, 439/578, 608, 610

(56) References Cited

U.S. PATENT DOCUMENTS 4,397,516 A * 8/1983 Koren et al. ..... 339/177 R
5,376,022 A * 12/1994 Carr et al. ..... 439/668
5,564,942 A * 10/1996 Lee ..... 439/462
5,573,411 A * 11/1996 Bartosz et al. ..... 439/95
5,595,499 A * 1/1997 Zander et al. ..... 439/532
5,676,565 A * 10/1997 Vagnoni ..... 439/580

* cited by examiner

*Primary Examiner*—Tho D. Ta
*Assistant Examiner*—Truc Nguyen

(57) ABSTRACT

A plug for connection to an RCA or phono type socket wherein a signal pin (15) is frictionally located within the bore of said socket and a pin-like return conductor (16) is adapted to make contact with the socket casing. The spacing (17) between the signal pin and return conductor is by means of a non-conductive plastic polymer or similar material, such material also assisting to engage the return conductor against the outside casing of the RCA socket. By reducing the amount of conductive metal material used in the return conductor of a typical RCA plug i.e. by using a pin-like return conductor rather than a cylindrical conductive band and associated support body, the present invention reduces inductive, capacitive and eddy current distortion and offers improved signal transmission.

2 Claims, 4 Drawing Sheets

FIGURE 1
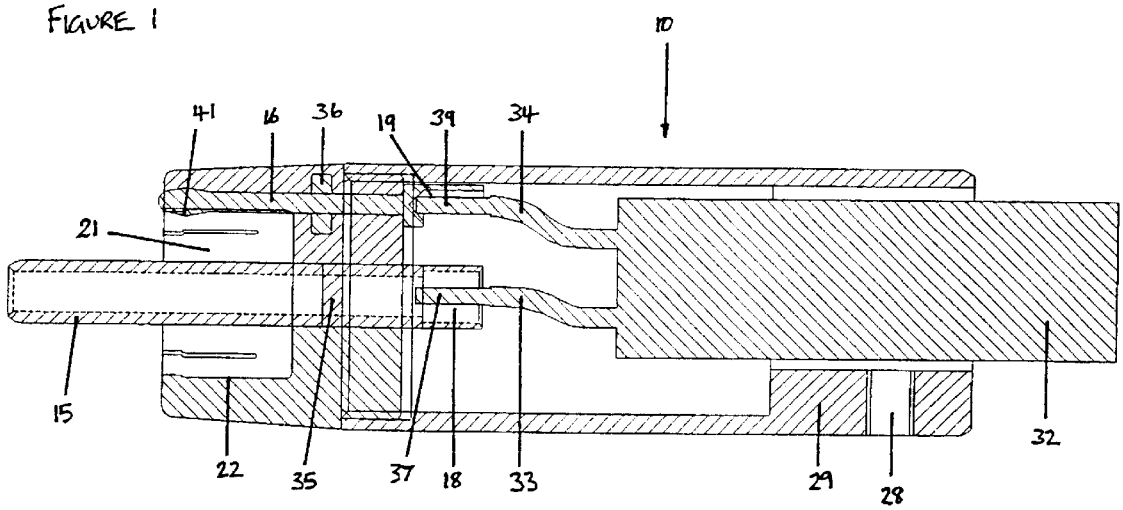
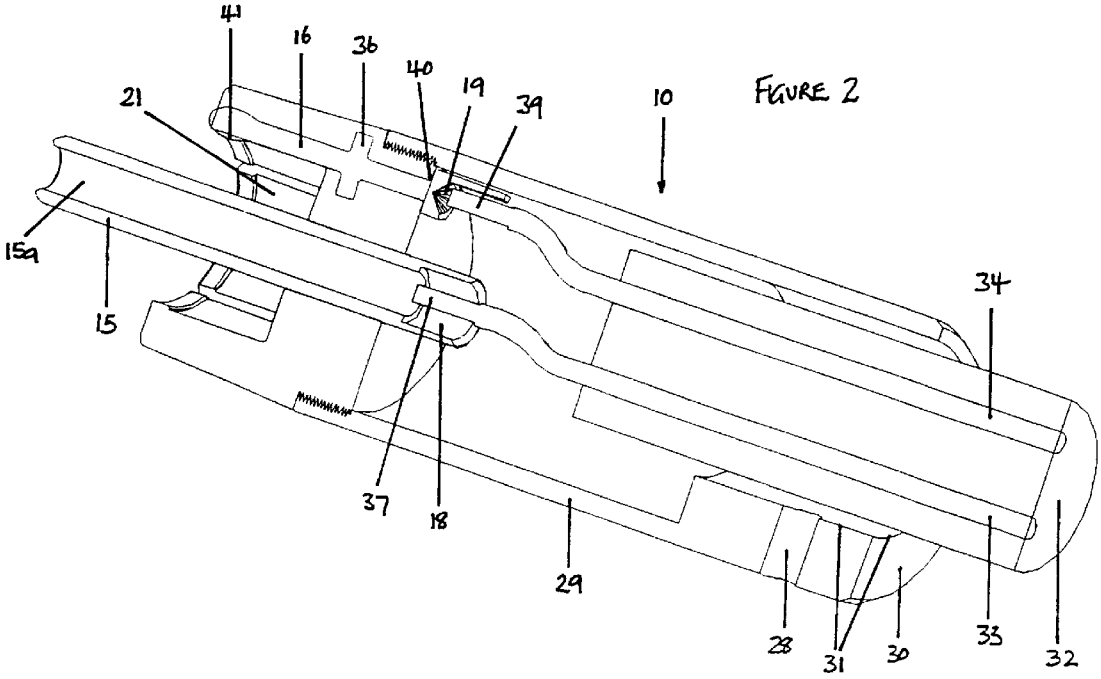
FIGURE 2

PLUG FOR CONNECTION TO AN RCA OR PHONO TYPE SOCKET

This invention relates to a plug for connection to an RCA or phono type socket.

This invention has particular but not exclusive application to audio electrical connections, and for illustrative purpose reference will be made to such application.

The RCA plug and socket connection system (a generic name for a phono type plug and socket connection system) has been criticized by electronic engineers and audio enthusiasts as being an inferior connection for high quality audio. The RCA plug and socket connection system was originally designed as a means of connecting antenna cables to televisions. It was never considered the best solution for audio applications but has become the de facto world standard plug and socket connection system as used in consumer electronic components worldwide.

The RCA plug is prone to capacitive and oxidative effects because of the poor fitting of some plug designs and due to the wide-ranging size of RCA sockets (7.95 mm to 8.55 mm diameter). It is also believed that the large amount of metal used in the construction of many RCA plugs is a cause of inductive and capacitive distortion, which in turn adversely affects sound reproduction.

Additionally, the cylindrical conductive band connection system used in typical RCA plugs to surround and make contact with the-outer casing of an RCA socket tends to disperse the flow of electrons. As a result the transmitted current flows through many different entry points, resulting in interfering eddy currents and consequent distortion.

Extensive listening tests reveal that most RCA plugs, including many expensive audiophile varieties, slow the flow of electrons and add coloration to the music signal. This is why many audio enthusiasts by-pass connections by "hard wiring" cables that connect audio equipment, thereby eliminating the deficiencies associated with the use of RCA plug and socket connectors.

The present invention aims to alleviate the above disadvantages and to provide a plug for connection to an RCA socket which will offer better sound and will be reliable and efficient in use.

With the foregoing and other objects in view, this invention in one aspect resides broadly in a plug for connection to an RCA socket having an external casing that is constructed from an electrically conductive material and an internal bore that is also lined with an electrically conductive material, said conductive materials being separated from each other by suitable insulation, said plug including;

a signal pin that is frictionally locatable within the bore, a return conductor which is adapted to make contact with the casing when said pin is located within the bore, and spacing means for maintaining said pin and said return conductor in an operative spaced relationship within an electrically non-conductive material, for example a plastic polymer such as Teflon, polyphenylene sulfide (PPS) etc.

The plug may also include retaining means that is intended to retain the return conductor in electrical contact with the casing. For example, the retaining means may include a spring that urges the return conductor towards the casing. Alternatively, the retaining means may include a recess having a continuous side wall, or a plurality of circumferentially spaced wall portions, which support the return conductor and retain the return conductor in contact with the casing when an end portion of the casing is frictionally located within said recess. The side wall of the casing may further include one or more breaks formed therein that allow the recess to engage sockets that exhibit minor variations in respect of the external diameter of the casing.

The main difference between the present invention and prior art is the incorporation of said return conductor in the form of a pin, as opposed to the typical cylindrical conductive band, to engage the outside casing of an RCA socket.

In the present invention the return conductor in the form of said pin makes contact with the outside casing of an RCA socket by means of a raised contact area at the front portion of the pin that may include but is not limited to shapes such as an ellipse, a sphere, a cylinder etc.

One advantage of the return conductor of the present invention is the fact that it comprises far less conductive metal material than the return conductor embodied in a typical RCA plug, thereby reducing distortion.

The return conductor may be constructed from a variety of electrically conductive materials, such as various brass, nickel, silver and copper alloys. The return conductor may also include at least one site along its length where the free end of an electrical wire may be soldered thereto. For example, the trailing end portion of the return conductor may include a seat extending rearwardly therefrom.

The signal pin may also be constructed from a variety of electrically conductive materials, such as various brass, nickel, silver and copper alloys.

The signal pin may be of solid or hollow construction. For example, the signal pin may be tubular and generally of constant transverse cross-section.

The signal pin may include at least one site along its length where the free end of an electrical wire may be soldered thereto. For example, the trailing end portion of the signal pin may include a seat extending rearwardly therefrom.

Selected portions of the signal pin, return conductor and spacing means may be enclosed within a housing that may be constructed from a variety of materials including various electrically non-conductive materials and heat resistant materials, such as plastic polymer and Teflon materials.

The housing may be provided with one or more apertures therein through which electrical wires and/or cable may extend and whereby in use the housing may provide protection for the connections between the wires and the signal pin and the return conductor.

In another aspect this invention resides broadly in a plug for connection to an RCA socket having an external casing that is constructed from an electrically material and an internal bore that is also lined with an electrically conductive material said conductive materials being separated from each other by suitable insulation, said plug including;

A signal pin that is frictionally locatable within the bore and which includes at least one site along its length, to which an electrical wire may be soldered, A return conductor which is adapted to make contact with the casing when said pin is located within the bore, said return conductor having at least one site along its length to which another electrical wire may be soldered, and, Spacing means for maintaining said pin and said return conductor in an operative spaced relationship within an electrically non-conductive material.

In order that this invention may be more easily understood and put into practical effect, reference will now be made to the accompanying drawings which illustrate a preferred embodiment of the invention, wherein:

FIG. 1 is a longitudinal cross-sectional side view of a plug that is constructed in accordance with the present invention, the plug being adapted for connection to an RCA socket;

FIG. 2 is a longitudinal cross-sectional isometric view of the plug illustrated in FIG. 1;

Figure 3:
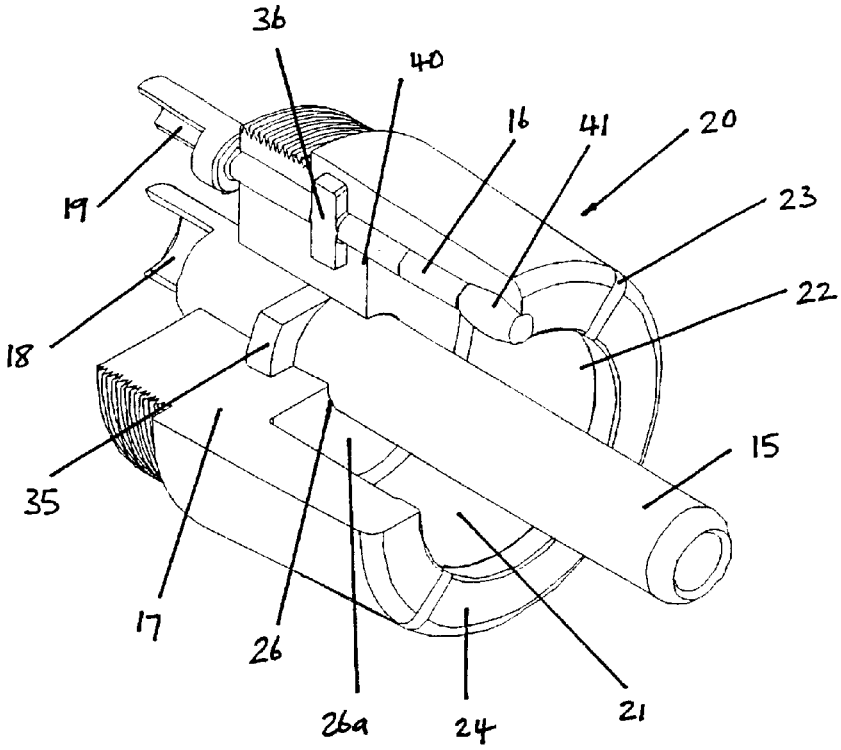
FIG. 3 is an isometric front view of the plug illustrated in FIG. 1, shown with the housing removed.
Figure 4:
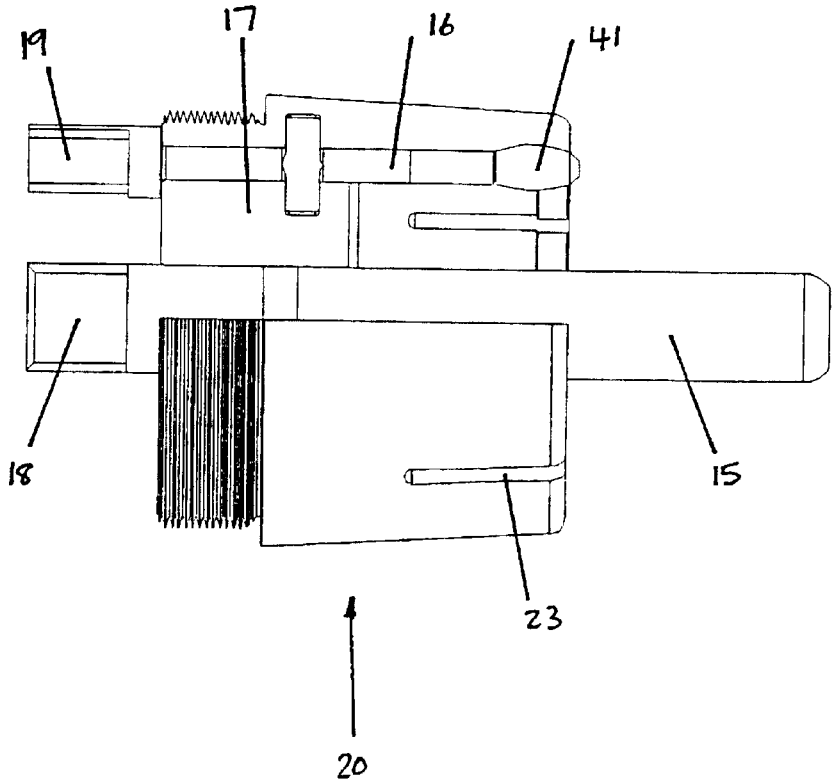
FIG. 4 is a side view of the plug illustrated in FIG. 1, shown with the housing removed.
Figure 5:
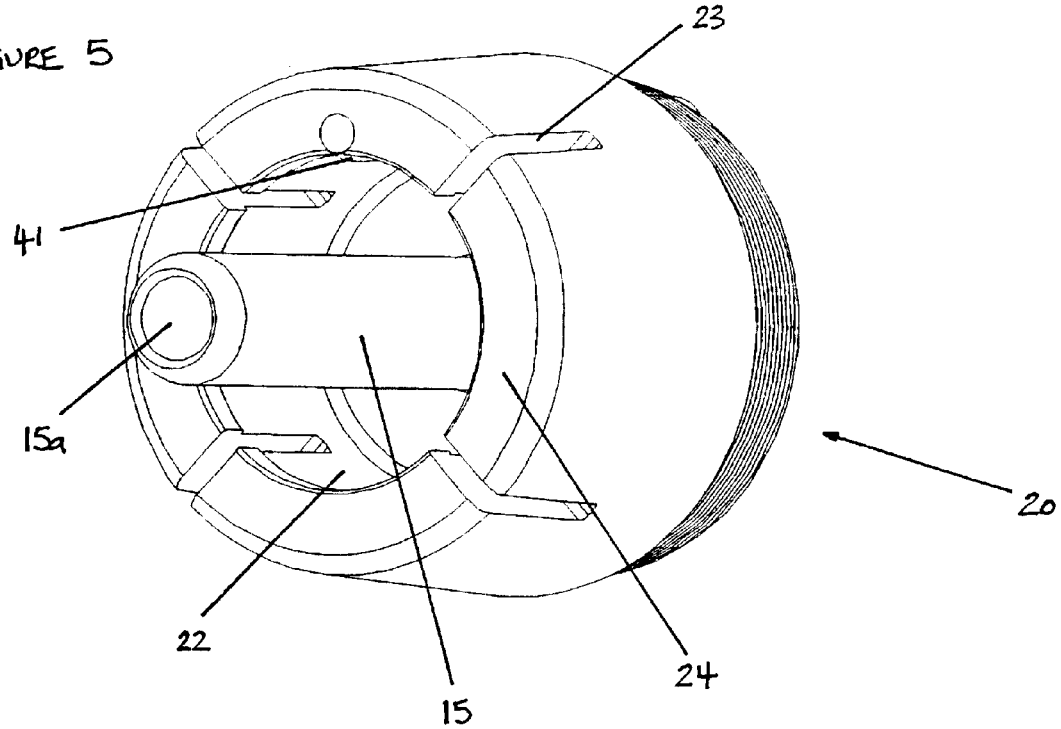
FIG. 5 is an isometric front view of the plug illustrated in FIG. 1, shown with housing removed, and showing the means by which the plug makes contact with an RCA socket.
Figure 6:
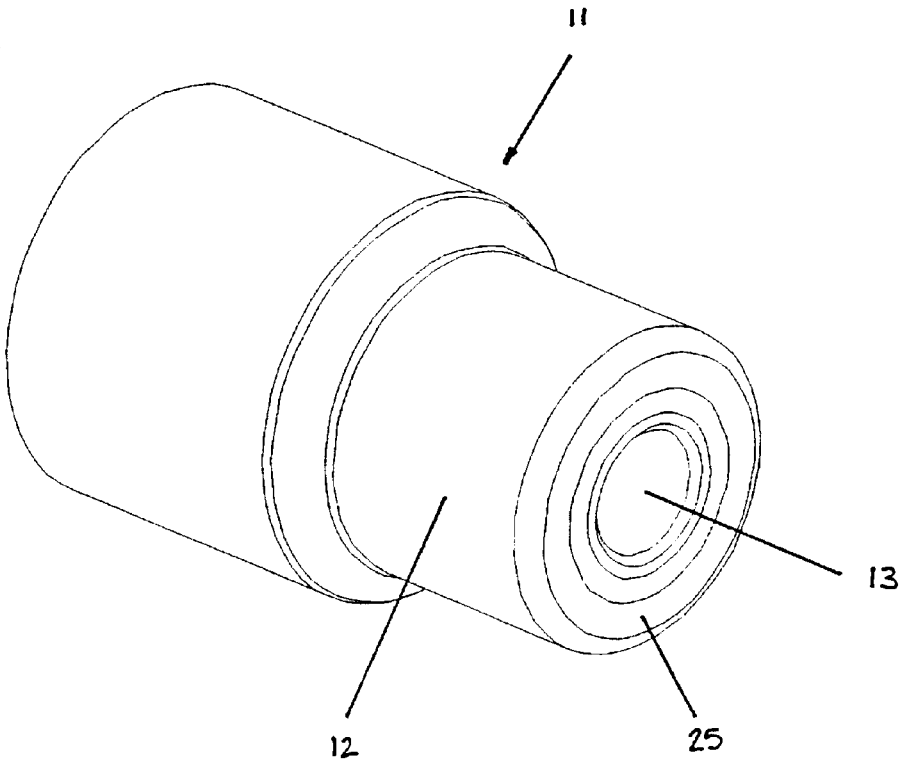
FIG. 6 is a typical RCA socket.
Figure 7:
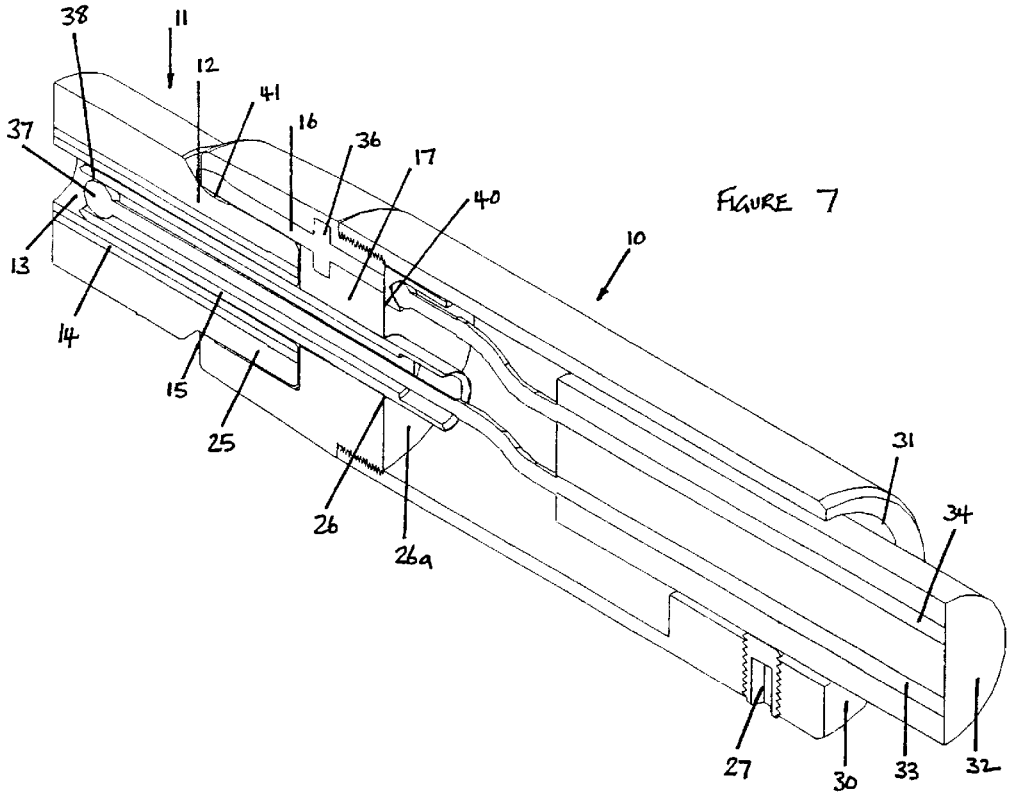
FIG. 7 is a longitudinal cross-sectional isometric view of the plug illustrated in FIG. 1 when operatively connected to an RCA socket, and showing an electrical cable operatively connected thereto.
Figure 8:
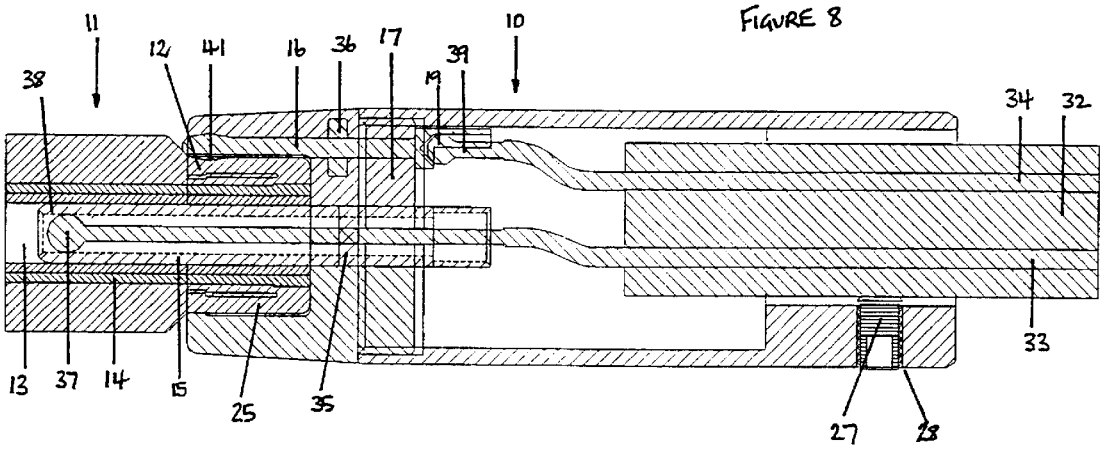
FIG. 8 is a longitudinal side view of the plug illustrated in FIG. 1 when operatively connected to an RCA socket, and showing an electrical cable operatively connected thereto.

FIGS. 7 and 8 show longitudinal cross-sectional views of a plug 10 that is operatively connected to an RCA socket 11 having an external casing 12, that is constructed from an electrically conductive material, and an internal bore 13, that is also lined with an electrically conductive material, said casing 12 and said bore 13 being separated from each other by suitable insulation 14.

The plug 10 includes a signal pin 15 that is frictionally locatable within the bore 13, a return conductor 16 which makes electrical contact with the casing 12 when the signal pin 15 is located within said bore, and spacing means 17 that maintains said signal pin 15 and said return conductor 16 in an operative spaced relationship.

The signal pin 15 is constructed from a suitable electrically conductive material, such as various brass, nickel, silver or copper alloys. The signal pin 15 consists of a cylindrical tube having a bore 15*a* of constant transverse cross-section and a rearwardly extending, channel shaped seat 18.

The return conductor 16 consists of a cylindrical pin constructed from a suitable electrically conductive material, such as various brass, nickel, silver or copper alloys, and includes a rearwardly extending, channel shaped seat 19.

The spacing means 17 is constructed from an electrically non-conductive material, such as plastic polymer or Teflon. The spacing means 17 includes a generally cylindrically shaped head portion 20 having an axially located, cylindrically shaped recess 21 that is defined by a substantially continuous internal side wall 22. The side wall 22 includes four equally spaced splits 23 that allow partial relative movement of the constituent wall portions 24 thereby enabling the recess 21 to frictionally receive a variety of RCA sockets 11 each having a cylindrically shaped end portion 25 of differing external diameter. The head portion 20 also includes a centrally located, longitudinally extending through bore 26, formed in an intermediate base wall 26*a* through which a portion of the signal pin 15 extends.

The signal pin 15 includes a holding lug 35 which protrudes perpendicularly from a position along the length of signal pin 15 to support and prevent movement of signal pin 15 within spacing means 17.

The return conductor 16 includes a holding lug 36 which protrudes perpendicularly from a position along the length of return conductor 16 to support and prevent movement of return conductor 16 within spacing means 17.

The return conductor 16 extends through an aperture 40 formed in the base wall whereby an elliptical shaped contact portion 41 of the return conductor 16 lies flush with, and protrudes marginally from the internal side wall 22 to make contact with the cylindrically shaped end portion 25 of an RCA socket.

The plug 10 also includes a cylindrically shaped, tubular housing 29 which is partially closed at one end by rear wall 30 which is provided with a centrally located aperture 31.

In use, the free end of a piece of cable 32 containing two or more electrical wires 33 and 34 is threaded through the aperture 31 prior to the placement of the housing 29 in it's operative position whereby it shrouds the rearward portions of both the signal pin 15 and the return conductor 16. The cable 32 is secured by use of grub screw 27 located through aperture 28 thereby making contact with the outer sleeve of appropriately sized cable 32.

The free exposed end portion 37 of the signal wire 33 may be supported by the seat 18, as illustrated in FIGS. 1 and 2, and subsequently connected thereto using a suitable electrical solder. Alternatively, the free exposed end portion 37 of the signal wire 33 may be extended through the bore 15*a* and subsequently soldered to a side wall of said bore adjacent to the tip 38, as illustrated in FIGS. 7 and 8.

The free exposed end portion 39 of the return wire 34 may be supported by the seat 19, as illustrated in FIGS. 1 and 2, and subsequently connected thereto using a suitable electrical solder.

When the plug 10 is operatively connected to an RCA socket 11, the signal pin 15 is frictionally located within the bore 13 and the contact portion 41 of the return conductor 16 bears against and thereby makes electrical contact with the adjacent casing 12 as illustrated in FIGS. 7 and 8.

When using the plug 10 with an appropriate audio cable, and in comparison to the same audio cable terminated with a standard RCA plug, it is believed that the sound quality is greatly enhanced. This appears to be due to enhanced electron flow within the plug as a result of diminished capacitive and inductive reactance.

It will of course be realised that the above has been given only by way of illustrative example of the present invention and that all such modifications and variations thereto as would be apparent to persons skilled in the art are deemed to fall within the broad scope and ambit of this invention as is herein before defined in the claims.

What is claimed is:

1. A plug, having signal and return (or ground) male conductive pins, for connection to an RCA or phono socket;

wherein the return or ground conductor of pin-like construction is held in an operative spaced relationship to the signal pin by means of non-conductive material such as plastic polymer, and adapted to make electrical contact with the socket's external ground casing when the signal pin is located within the socket's internal signal bore, and when the plug's retaining means, such as a continuous side wall or a plurality of circumferentially spaced wall portions, of said non-conductive material engages the socket's external ground casing applying pressure to and forcing said return or ground conductor against the socket's external ground casing.

2. The plug of claim 1 where the rearward portions of said signal pin and said return conductor may accept connection to the respective signal and return wires of an electrical cable.

* * * * *